US005857862A

United States Patent [19]

Muench et al.

[11] Patent Number: 5,857,862

[45] Date of Patent: Jan. 12, 1999

[54] LOADBREAK SEPARABLE CONNECTOR

[75] Inventors: Frank John Muench, Waukesha; John Mitchell Makal, Menomonee Falls, both of Wis.

[73] Assignee: Cooper Industries, Inc., Houston, Tex.

[21] Appl. No.: 811,180

[22] Filed: Mar. 4, 1997

[51] Int. Cl.[6] ..... H01R 13/53

[52] U.S. Cl. ..... 439/181; 439/921

[58] Field of Search ..... 439/135, 148, 439/181, 183–187, 843, 921; 174/37, 73.1

[56] References Cited

U.S. PATENT DOCUMENTS

| | | |
|---|---|---|
| 1,877,586 | 9/1932 | Rah . |
| 2,379,942 | 7/1945 | Webber . |
| 3,376,541 | 4/1968 | Link . |
| 3,509,516 | 4/1970 | Phillips . |
| 3,509,518 | 4/1970 | Phillips . |
| 3,534,323 | 10/1970 | Becker et al. . |
| 3,555,487 | 1/1971 | Jones . |
| 3,617,987 | 11/1971 | Sankey . |
| 3,711,818 | 1/1973 | Swehla . |
| 3,725,846 | 4/1973 | Strain . |
| 3,860,322 | 1/1975 | Sankey et al. . |
| 4,175,815 | 11/1979 | Andersen et al. . |
| 4,758,171 | 7/1988 | Hey . |
| 4,904,932 | 2/1990 | Schweitzer, Jr. . |
| 5,221,220 | 6/1993 | Roscizewski . |

*Primary Examiner*—Khiem Nguyen
*Attorney, Agent, or Firm*—Burns, Doane, Swecker & Mathis LLP

[57] ABSTRACT

A novel protective cap or elbow connector comprises a semi conductive insert which includes an additional volume of air which surrounds energized portions of the elbow connector or protective cap beyond what is necessary to accommodate a female bushing. During separation of the elbow connector or protective cap from the female bushing, the semiconductive insert stretches, which increases the volume of the interior space between the elbow connector or protective cap and the female bushing. Because the additional volume of air is provided, the reduction in pressure during separation is lessened, so that the dielectric strength of the air surrounding energized portions of the elbow connector or protective cap is maintained at a higher level. The increased dielectric strength of the air significantly reduces the possibility of a flashover occurring during separation of the elbow connector or protective cap from the female bushing.

24 Claims, 4 Drawing Sheets

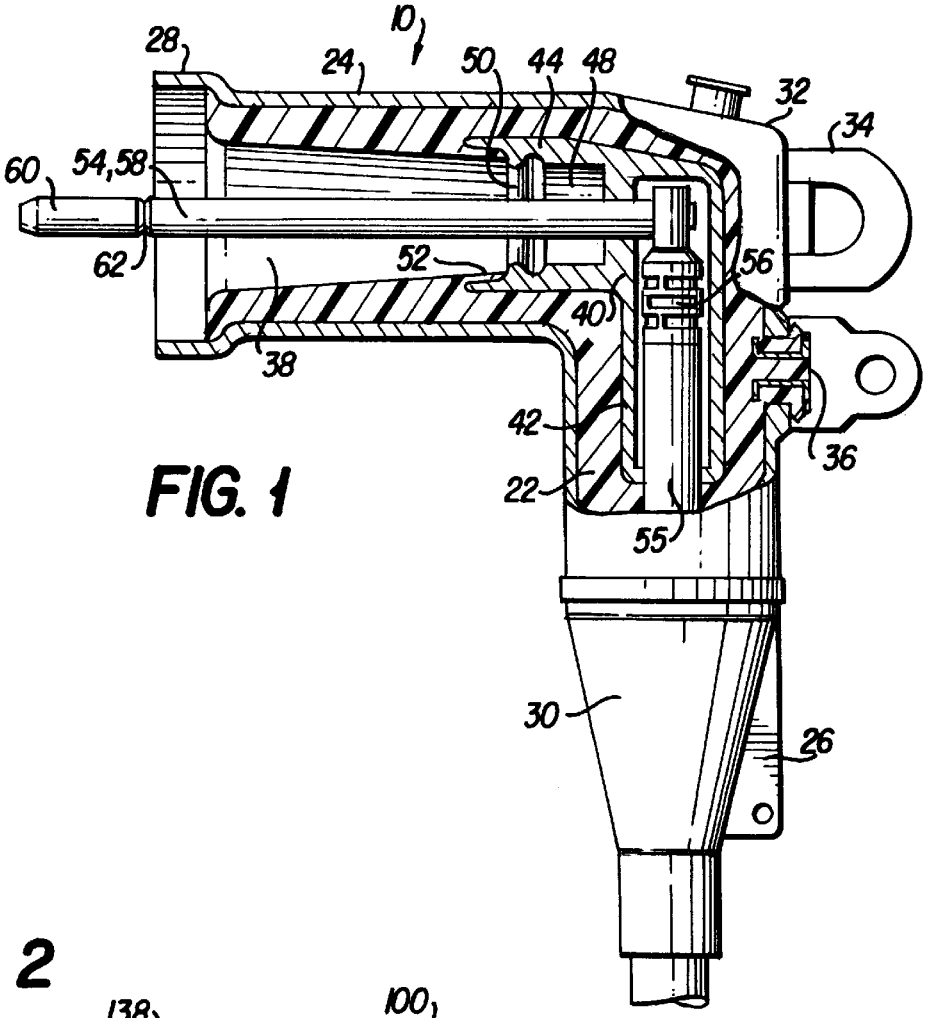
FIG. 1
FIG. 2
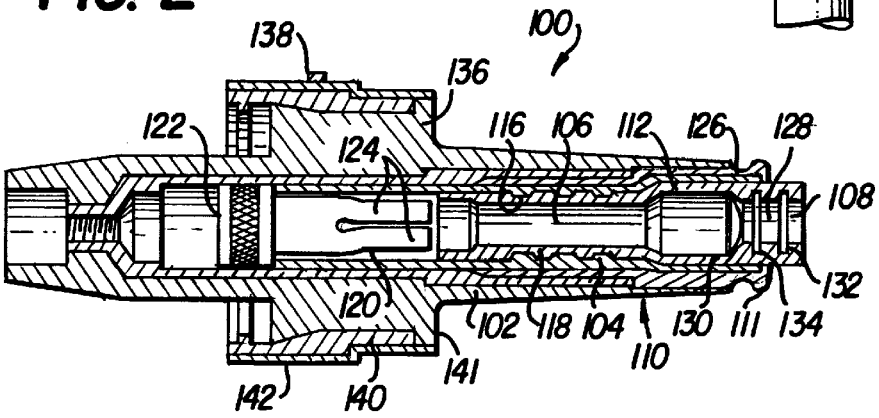
FIG. 3
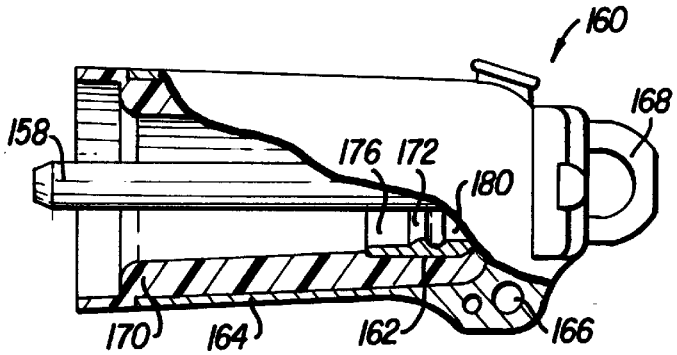

FIG. 4
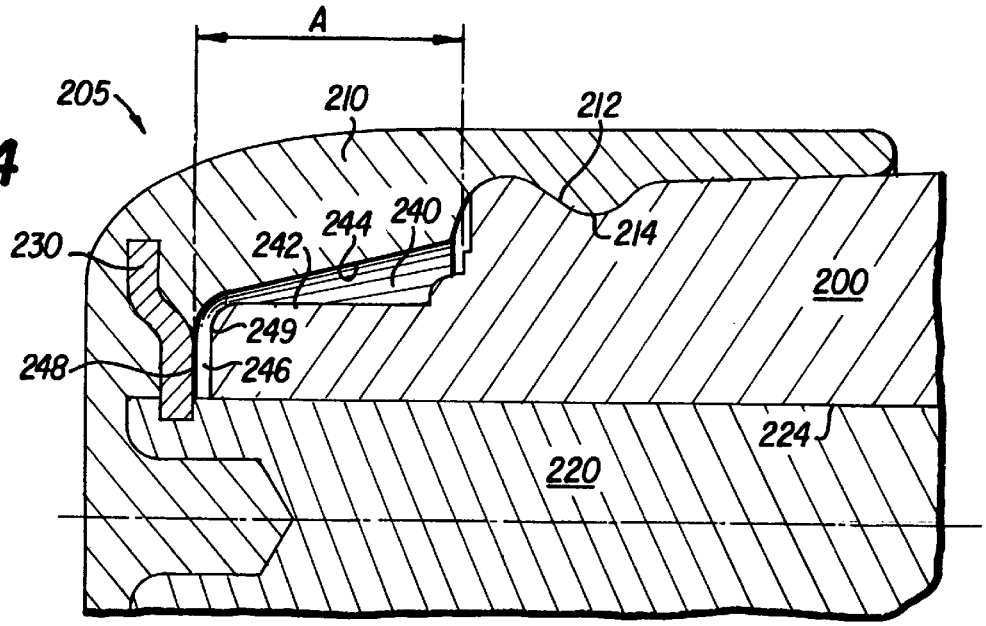
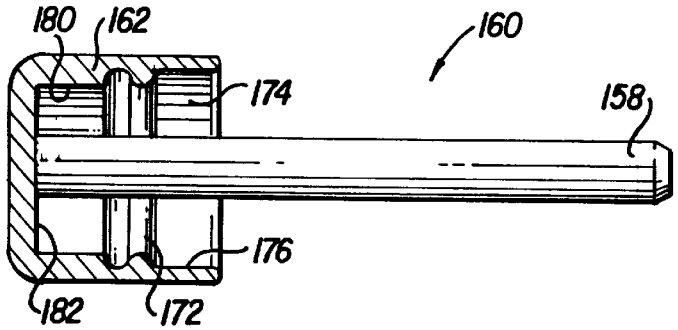
FIG. 5
FIG. 6
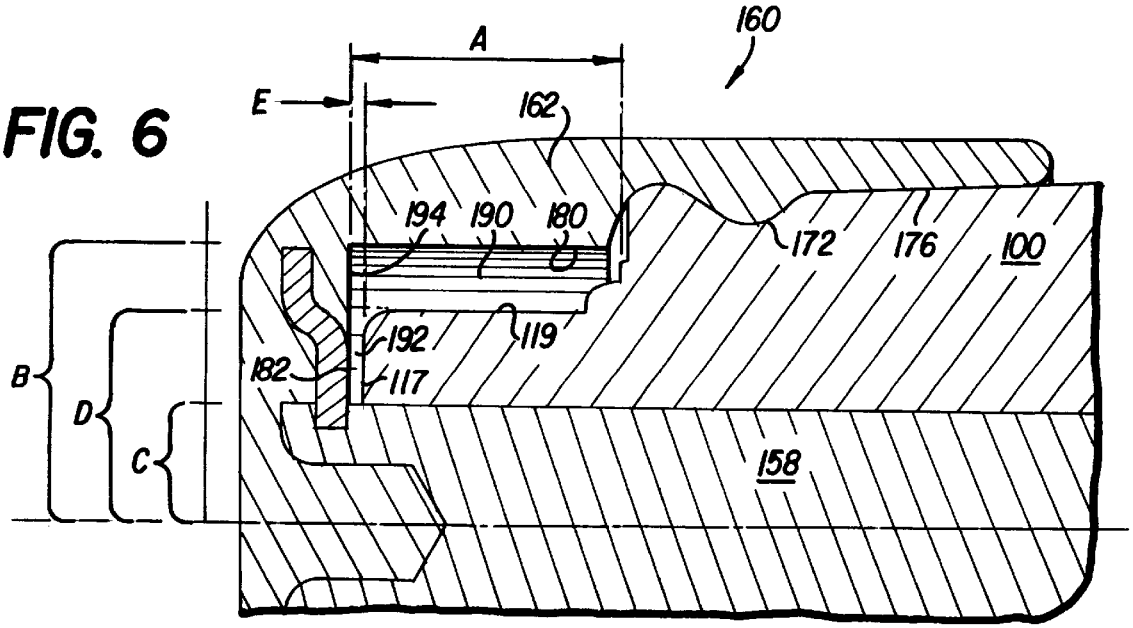

LOADBREAK SEPARABLE CONNECTOR

BACKGROUND

1. Field of the Invention

The present invention relates to electrical connector assemblies such as those used to connect portions of electrical utilities, and more particularly, to loadbreak separable connectors.

2. Description of the Related Art

High-voltage separable connectors interconnect sources of energy, such as transformers, to distribution networks and the like. Frequently, it is necessary to connect and disconnect the electrical connectors. These connectors typically feature a male connector which contains a male contact, and a female connector which contains a female contact. The male connector may be in the form of an elbow connector or a protective cap, for example, and the female connector may be in the form of a bushing. The male contact is typically maintained within the elbow connector or protective cap, and the female contact is contained within the bushing.

Disconnecting energized connectors is an operation known as loadbreak. During loadbreak, the male connector (e.g., elbow connector or protective cap) is pulled from the female connector (e.g., bushing) using a hotstick to separate the connectors. This, in effect, creates an open circuit. During loadbreak, a phenomenon known as a flashover may occur, whereby an arc from an energized connector extends rapidly to a nearby ground. Existing connector designs contain a number of arc extinguishing components so that the connectors can have loadbreak operations performed under energized conditions with no flashover to ground occurring. Even with these precautions, however, flashovers have occurred on occasion.

A breakdown in dielectric strength of the air surrounding the metal contacts can occur before the metal contacts that carry the load current actually separate. This breakdown may result in a small flash which causes little or no damage, but which may cause contamination of the interface between the male connector and female connector. On rare occasions, the flash is accompanied by a power follow current that can cause a large external arc. A large external arc may damage the equipment or possibly create a power outage.

The reduction in dielectric strength arises because the dielectric strength of air is a function of pressure. When the connectors are being disconnected, a partial vacuum is created by the expansion of the volume of the enclosed space between the male connector and the female connector. The increased volume during this initial separation results in a lower air pressure and reduced dielectric strength of the air surrounding the energized portions of the connectors.

The reduction in dielectric strength may be especially pronounced in cold weather, for example, or where the lubricating grease between the connectors has evaporated or has been forced out of the interface between the male connector and the female connector. Without sufficient lubrication, the elbow connector or protective cap grabs the bushing tightly, causing the elbow or cap to stretch to a significant extent before separating. This further expands the cavity between the elbow or cap and bushing, resulting in a significant reduction in pressure and dielectric strength, which increases the likelihood of a flashover.

The reduction in air pressure during disconnection also increases the force required to separate the male connector from the female connector, as the suction tends to increase the force which holds the parts together. Conversely, the surrounding air must be compressed during insertion of the male connector onto the female connector, which increases the force necessary to connect the two parts.

SUMMARY

The present invention provides an electrical connector with increased dielectric strength to protect against the possibility of flashover. According to exemplary embodiments of the invention, a protective cap or elbow connector containing a male probe/contact is provided. It is designed with sufficient size and spacing to use the dielectric strength of the air surrounding energized portions of the male contact and bushing to insulate the energized parts, preventing current flow when the male connector is being disconnected from the female connector.

According to a preferred embodiment, this may be accomplished by adding an additional air space in the region of the male connector proximate to the locking ring of the semiconductive insert. The additional air space may take the form of one or more cylindrical bores, for example, and may be provided by reshaping the insert of the male connector by removing insert material from nonessential regions.

The additional air space may also be added to the region between the end of the female connector and the inner end wall of the male connector. For example, the space which receives the end of the female connector may be extended in length from the locking ring beyond that which is necessary to physically accommodate the female connector.

Other embodiments of the invention open the area around the conductive probe in an elbow connector, adding volume and increasing communication with the volume of air in the cable termination section of the insert. The shape of the insert in the region where it mates with the cable may also be adapted to add an additional volume of air.

The increased volume of the cavity between the male connector and the female connector effectively reduces the effects of expanding the cavity as the male connector is stretched during removal. For example, by providing an additional volume of air between energized portions of the connector assembly, the reduction in pressure as the connector assembly is separated is reduced. A smaller reduction in pressure results in less reduction of the dielectric strength of the air surrounding energized portions of the connector assembly, which significantly reduces the possibility of a flashover.

The smaller change in pressure during connection or disconnection also reduces suction during disconnection, which reduces the force required to separate the male connector from the female connector. And, the air compression is reduced during connection, which reduces the force required to push the male connector onto the female connector.

An electrical connector according to a preferred embodiment of the invention comprises a first member which includes an opening for receiving a second member, a first electrical contact of the first member for making electrical contact with a second electrical contact of the second member, and a first retaining surface of the first member which contacts a second retaining surface on the second member to retain the second member in the first member. When the second member is retained in the first member, a first space having a first volume is defined between the first member and the second member, and when the second member is removed from the first member to a point at which the second member is no longer retained in the first member, the first space has a second volume.

BRIEF DESCRIPTION OF THE DRAWINGS

The foregoing and other objects, features and advantages of the present invention will be more readily understood upon reading the following detailed description in conjunction with the drawings in which:

FIG. 1 illustrates an elbow connector according to an exemplary embodiment of the invention;

FIG. 2 illustrates a female connector according to an exemplary embodiment of the invention;

FIG. 3 illustrates a protective cap according to an exemplary embodiment of the invention;

FIG. 4 illustrates portions of a conventional protective cap into which is inserted the end of a female connector;

FIG. 5 illustrates portions of the protective cap of FIG. 3;

FIG. 6 is an enlarged view of portions of the protective cap of FIG. 3;

DETAILED DESCRIPTION OF THE PREFERRED EMBODIMENTS

Figure 7:
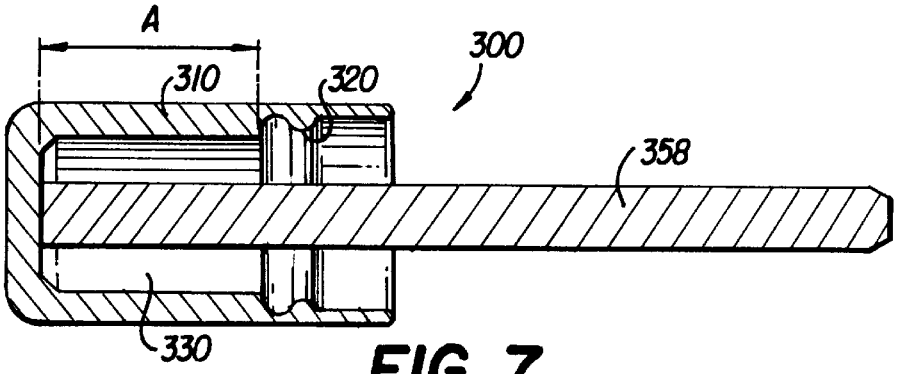
FIG. 7 illustrates a protective cap according to another embodiment of the invention.

The construction and operation of conventional electrical connector assemblies, which are in many respects similar to that described herein, are well known and have been in use for many years. Reference is made, for example, to commonly-owned U.S. Pat. No. 5,221,220, issued Jun. 22, 1993, to Roscizewski, the subject matter of which is hereby incorporated herein by reference.

Referring initially to FIGS. 1 and 2, an electrical connector assembly according to an exemplary embodiment of the present invention includes a male connector, such as an elbow connector 10 (FIG. 1), electrically connected to a portion of a high-voltage circuit (not shown), and a female connector 100 (FIG. 2), as for example a bushing insert or connector, connected to another portion of the high-voltage circuit. The male connector may alternatively comprise a protective cap 160 as shown in FIG. 3. The male and female connectors are reversibly connectable and respectively interfit to achieve electrical connection.

The elbow connector 10 includes an elastomeric and electrically-insulating housing 22 of a material such as EPDM (ethylene-propylene-dienemonomer) rubber which is provided on its outer surface with a semiconductive shield layer 24 that may be grounded by means of a perforated grounding tab 26. The semiconductive shield may comprise semiconducting EPDM. The elbow connector 10 may comprise an upper portion 28 and a lower portion 30 connected at a central portion 32. A pulling eye 34 extends from the central portion 32. An optional test point 36 is located along the lower portion 30. A generally conical bore 38 is disposed within the housing 22.

A semiconductive insert 40 is contained within the housing 22 such that a lower portion 42 of the insert 40 extends into the lower portion 30 of the elbow connector 10. An upper portion 44 of the insert 40 extends into the upper portion 28 of the elbow connector 10. The insert 40 has a recess 48 which receives an end of the female connector 100. The insert 40 includes a locking ring 50 which mates with a corresponding locking groove 126 on the female connector 100. The insert 40 may be formed of a flexible, elastic, or rubber-like material such as a semiconductive EPDM.

A probe assembly 54 is disposed within the housing 22 and aligned with the axis of the conical bore 38. The probe assembly 54 features a male contact element or probe 58 formed of an electrically conductive material such as copper. The probe assembly 54 threadedly engages a cable connector 56. The cable connector 56 is connected to a cable 55 to make electrical contact with the cable 55 and is disposed within the lower portion 30 of the elbow connector 10. The probe assembly 54 extends from the cable connector 56 into the bore 38.

The probe assembly 54, as well as other exposed conductive parts or ground planes such as the insert 40, may be partially covered with an insulating sheath to prevent flashover, as described in commonly owned U.S. application Ser. No. 08/478,562, the subject matter of which is hereby incorporated herein by reference. For example, an insulative layer 52 of electrically-insulating material may be provided within the bore 38 of the insert 40. The insulative layer 52 preferably comprises EPDM and may be unitarily molded with portions of the housing 22 during manufacture. The insulative layer 52 preferably extends at least partially along the inner surface of the insert 40. The insulating sheath along the probe assembly 54 (not shown) and along the insert 40 (element 52) increases the dielectric withstand capability of the system by increasing the distance from energized portions of the male connector to nearby ground planes.

An arc follower 60 of ablative material may be provided at the end of the probe 58. A preferred ablative material for the arc follower 60 is acetal co-polymer resin loaded with finely divided melamine. The ablative material is typically injection molded onto a reinforcing pin (not shown). An annular junction recess 62 is disposed at the junction between the probe 58 and the arc follower 60.

FIG. 3 illustrates a novel protective cap 160 according to an exemplary embodiment of the invention. The protective cap 160 includes a probe 158 which is received by the female connector 100, an insulating housing 170, and a semiconductive shield 164 which may be grounded by electrically connecting a grounding eye 166 to ground potential. The probe 158 is formed of an electrically conductive material such as copper. The housing 170 may comprise an electrically insulating material such as EPDM rubber, or more specifically, peroxide-cured EPDM rubber. The semiconductive shield 164 may be formed of semiconductive EPDM.

The protective cap 160 also includes a pulling eye 168 for removing the protective cap 160 from the female connector 100. As with the elbow connector 10, the protective cap 160 includes a semiconductive insert 162 in which is formed a locking ring 172 which engages with the locking groove 126 of the female connector 100 to secure the protective cap 160 to the female connector 100. The insert 162 may be formed of a semiconductive EPDM to control electrical stresses at the nose of the female connector 100.

When energized, the female connector 100 may be covered by either the elbow connector 10 or the protective cap 160. The protective cap 160 is used to electrically insulate and mechanically seal the female connector 100. The elbow connector 10 connects the female connector 100 to another portion of a high voltage circuit.

FIG. 2 illustrates an exemplary female connector 100, which is featured as a bushing insert comprised generally of an outer electrically insulative layer 102 and an inner rigid, metallic, electrically conductive tubular assembly with associated components. The construction and operation of female connectors of this type are well-known in the art.

However, the major components will be described herein to the extent necessary to understand the present invention.

The female connector 100 may be electrically and mechanically mounted to a bushing well (not shown) disposed on the enclosure of a transformer, for example, or other electrical equipment. The female connector 100 has a central passageway 106 therethrough which presents a forward opening 108 for receiving a probe 58 or 158 of a male connector. The passageway 106 is largely defined by a nose section 110 having a radially central portion 112. The central portion 112 features an insulated chamber 116 having a metallic interior which is radially surrounded by an arc interrupter 118.

A female contact member 120 is disposed toward the rear of the chamber 116 and is maintained in a radially central position by a copper knurled piston 122 through which the female contact member 120 may be electrically and mechanically coupled to a bushing well (not shown). For purposes of description, the term "rear" shall mean the direction toward the bushing well of the electrical equipment and the term "forward" shall mean the direction toward the nose section 110 and the male connector.

The female contact member 120 has forwardly extending collet fingers 124 which are designed to grip the probe 58 or 158 of the male connector (e.g., elbow connector or protective cap). The nose section 110 has a cylindrically shaped nose piece 111 having an external circumferential locking groove 126 which serves as a securing detent for the complimentary locking ring 50, 172 associated with the insert 40, 162 of the elbow connector 10 or protective cap 160, respectively.

The forward end of the central passageway 106 includes an entrance vestibule 128 immediately rearward of the opening 108. The vestibule 128 may be separated from the chamber 116 by a hinged gas trap 130 which is operable between an open position, wherein gas communication is possible between the chamber 116 and the vestibule 128, and a closed position, wherein gas communication is substantially prevented between the chamber 116 and vestibule 128. The gas trap 130 is spring-biased toward the closed position and may be moved to its open position as the probe 58, 158 of the elbow connector 10 or protective cap 160 is disposed within the central passageway 106 through the vestibule 128 and into the chamber 116. A pair of elastomeric O-rings 132, 134 are located within the vestibule 128.

A portion of the outer electrically insulative layer 102 forms a radially enlarged section 136 which surrounds the central portion 112. One or more ground tabs 138 are provided and are positioned at the radial exterior of the enlarged section 136. The enlarged section 136 also carries an annular semi-conductive shield 140 about its circumference which presents a forward bushing shoulder 141. In conventional electrical connector assemblies, this shield 140 provides a ground plane to which an arc might tend toward during a flashover. A thin sleeve of insulative material 142 is disposed along the outer radial surface of the semi-conductive shield 140. The sleeve 142 may be of any suitable shape, thickness or material. It is preferred, however, that the sleeve 142 be formed of an insulative polymeric material such as rubber or plastic. A suitable thickness for the sleeve 142 has been found to be 0.015–0.060 inch. The sleeve 142 preferably extends rearward from the bushing shoulder 141 to cover at least a portion of the shield 140. Preferably, the sleeve 142 encloses or encapsulates the entire outer radial surface of the shield 140.

During a loadbreak or switching operation, the male connector (e.g., elbow connector 10 or protective cap 160) is separated from the female connector 100 (e.g. bushing insert). The connectors are energized when they are electrically connected to a high voltage distribution circuit. During a loadbreak operation, separation of electrical contact occurs between the probe 58, 158 and the female contact member 120.

In a conventional connector assembly, arcing may unexpectedly and undesirably occur during loadbreak operation, the arc likely extending from exposed conductive portions of the probe or the insert of the male connector to a nearby available ground plane. Arcing or flashover in a conventional connector assembly may be caused by a reduction in the dielectric strength of the air which surrounds energized portions of the connectors during disconnection. The reduction in dielectric strength arises because the dielectric strength of air is a function of pressure. The relationship between pressure and dielectric strength is expressed in Paschen's law.

At atmospheric pressure, air has a given dielectric strength. As the pressure falls to about 0.1 atmospheres, the dielectric strength of the air falls linearly. The dielectric strength of air stabilizes at a relatively low level, in the range of 0.1 atmospheres to 0.001 atmospheres, at which level, the dielectric strength begins to increase dramatically at these very low vacuum levels.

In the space between a conventional elbow connector or protective cap and female connector, the pressure during disconnection may fall to a level in the minimum dielectric strength region.

In conventional connector assemblies, the male connector, which may comprise an elastomeric material, is slightly smaller than the female connector, so that it is stretched during connection, by the female connector. The stretching causes the parts to fit together intimately, which increases the dielectric strength of the joint formed by the parts. However, the only air in the system is caught between the end of the female connector locking groove and the open space at the back of the male connector.

FIG. 4 shows portions of a conventional connector assembly which includes a female connector 200 fully inserted into an insert 210 of a protective cap 205. The female connector 200 includes an annular locking groove 212 which engages with a complementary locking ring 214 of the protective cap 205. The protective cap 205 also includes a probe 220 which is received in a central bore 224 of the female connector 200. The probe 220 may be retained in the insert 210 of the protective cap 205 by means of a retaining ring 230.

The elbow and cap have a tapered inner surface that is slightly smaller than the tapered surface of the bushing. Therefore even after the latching mechanisms separate, the interface remains sealed, until the mutual tapered surfaces clear each other.

As shown in FIG. 4, when the female connector 200 is fully inserted into the insert 210 of the protective cap 205, a narrow first space 240 remains between the side 242 of the female connector 200 and a conical wall 244 of the insert 210. A small second space 246 also remains between the end 249 of the female connector 200 and an inner end wall 248 of the insert 210. In general, the only air in a conventional connector assembly results from clearance allowances to ensure there are no physical interferences between parts.

In a conventional elbow connector (not shown) in which the insert has the shape of the insert 210 of the protective cap 205 in FIG. 4, there is also a volume of air surrounding the cable connector. This volume, however, is quite small. The air around the cable connector is also blocked from easily communicating with the space adjacent to end of the female connector due to the close fit between the probe and the insert.

During a normal disconnection in the conventional connectors, the volume of air typically increases by a factor of 7 as the elbow connector moves relative to the bushing, before the two interfaces actually separate, allowing the air surrounding the elbow connector bushing to fill the area between the elbow and bushing.

During disconnection of the protective cap 205 or elbow from the female connector 200, the insert 210 stretches because it is made of an elastomeric material. Typically, the insert 210 stretches to such an extent that the first and second spaces 240, 246 between the female connector 200 and the insert 210 may increase to about three times the original volume, in addition to the added volume that normally appears during separation. In addition, the extent of stretching may be increased by a number of factors. For example, the female connector 200 may stick to the insert 210 of the protective cap 205 due to cold weather or due to the drying out of a lubricant between the female connector 200 and the protective cap 205.

According to Boyle's law, the product of the pressure and volume of a gas in a closed system is a constant. That is, the initial pressure $P_i$ times the initial volume $V_i$ equals the final pressure $P_f$ times the final volume $V_f$. Rearranging this relationship shows that $P_f=P_iV_i/V_f$. Since $V_i$, the total space 240, 246 between the female connector 200 and the insert 210, is quite small, it requires only a small change in the final volume $V_f$ to reduce the pressure in the first and second spaces 240, 246 significantly, for example to 30% or less of the original value.

Such an increase in volume of air between the two connector components commonly occurs by the combination of stretching the insert 210 during disconnection and the normally increased volume that occurs prior to interface separation. According to Paschen's law, the corresponding reduction in pressure may reduce the dielectric strength of the air in the spaces 240, 246 to close to its minimum value. Arcing is therefore more likely to occur from the energized insert 210 or probe 220 to a nearby ground plane.

FIGS. 5 and 6 illustrate portions of the protective cap of FIG. 3 according to an exemplary embodiment of the invention. As shown in FIG. 5, the protective cap 160 includes a semiconductive insert 162 having a bore 174 which receives the nose of the female connector 100. The bore 174 includes a front section 176 which may be generally in the shape of a cone, a rear section 180 which has a rear inner wall 182, and a locking ring 172 disposed between the front section 176 and the rear section 180. The semiconductive insert 162 may be formed of a flexible, elastic, or rubber-like material such as semiconductive EPDM which stretches during disconnection of the protective cap 160 from the female connector 100.

FIG. 6 is an enlarged view of an exemplary protective cap 160 in which the female connector 100 has been inserted. As shown in FIG. 6, the insert 162 provides a first space 190 in the rear section 180 between the insert 162 and a side 119 of the female connector 100. A second space 192 is provided between the end 117 of the female connector 100 and the inner end wall 182 of the insert 162. The first and second spaces 190, 192 are preferably configured to have a volume which reduces the drop in air pressure during separation of the protective cap 160 from the female connector 100.

According to a preferred embodiment, the rear section 180 of the insert 162 has a depth A of about 0.5120 to 0.5150 inches, an outer radius B of 0.6044 inches, and an inner radius C, delimited by the probe 158, of 0.25 inches. The end 117 of the female connector 100 has a radial dimension D of about 0.4661 inches. The end 117 of the female connector 100 may be spaced from the end wall of the insert 162 by a distance E of about 0.036 inches. These dimensions are given by way of example and are not limiting to the present invention.

With the above dimensions, the volume of the first space 190 is approximately $\pi A(B^2-D^2)=0.2381$ cubic inches. The volume of the second space 192 is approximately $\pi E(D^2-C^2)=0.0175$ cubic inches. The total initial volume of the first and second spaces 190, 192 of FIG. 6 is therefore approximately 0.2556 cubic inches.

Tests have indicated that the protective cap 160 typically stretches by about 0.43 inches before it separates from the female connector 100. The stretching of the protective cap 160 is concentrated in the region of air space 190, 192 since the protective cap 160 is tightly locked to the female connector 100 in the other regions.

Since the elongation occurs primarily in the first space 190, the cross sectional area (0.4651 square inches) of the first space 190, multiplied by the increase in depth (0.43 inches) of the first space 190, yields an increase in volume of about 0.2 cubic inches during stretching. The walls of the insert 162 around the first space 190 may collapse somewhat when the insert 162 is stretched. As the insert 162 stretches, it pulls toward the center, reducing the outer diameter and inner diameter in the region where it is stretching. The result is a lengthening of the air space 190, accompanied by a reduction in outer diameter. The reduction in the outer diameter is estimated to be about 50%, which reduces the effective increase in volume by about 50%, from 0.2 cubic inches to 0.1 cubic inches.

In addition, the movement of the cap (or elbow) that occurs prior to the separation of the interfaces also increases the size of the space, further reducing the air pressure.

A conservative estimate of the net result is that stretching the protective cap 160 by 0.43 inches adds about 0.1 cubic inches to the volume originally present in the spaces 190, 192. The initial volume was shown to be 0.2556 cubic inches. The final volume due to stretching alone is 2556+0.1=0.3556 cubic inches. Prior to taking into account any drop in volume due to telescoping of the two connector components, the pressure drops to about 71.9% of the initial pressure. Assuming the initial pressure is equivalent to atmospheric pressure of 14.7 psi, the resultant final pressure is 10.7 psi.

In the conventional protective cap shown in FIG. 4, the first space 240 has a volume which is about half of the volume of the first space 190 of the novel protective cap of FIG. 6. The initial volume of the spaces 240, 246 between the female connector 200 and the insert 210 is therefore 0.2556/2+0.0175=0.1453 cubic inches. The final volume is the initial volume plus the increase in volume (0.1 cubic inches), which yields 0.2453 cubic inches. The pressure in the first and second spaces 240, 246 of the FIG. 4 device therefore drops from atmospheric pressure to 59.2% of atmospheric pressure during separation, or 8.71 psi, based only on stretching. This significantly reduces the dielectric strength of the surrounding air according to Paschen's law.

Accordingly, comparing the connectors illustrated in FIGS. 4 and 6, it can be seen that the connector of FIG. 6 has about 1.75 times as much space in it than does the FIG. 4 connector, i.e., which is necessary for clearance. In other embodiments a connector according to the present invention may have twice as much space, or even greater, than is necessary for clearance.

In addition to the stretching, as the two conventional components 200, 210 slide with respect to each, there is an additional increase in volume between the two components. It is estimated that the total change in volume, created by both telescoping and stretching, increases the volume about 7 times, from about 0.1453 cubic inches to roughly 1.0171 cubic inches. With respect to the embodiment of the present invention illustrated in FIG. 6, the initial volume between the two components 100, 162 is about twice the initial volume that is between the two conventional components. Accordingly, as the two embodiments 100, 162 of FIG. 6 are separated, the increase in volume is only about 3½ times the original volume, as compared with 7 times in the conventional device.

Based on these volume changes, the pressure in the conventional device should drop to about 14% of atmospheric pressure and the pressure in the preferred embodiment of the present invention should drop to about 29% of atmospheric pressure. However, due to numerous reasons, the pressure usually does not drop to the ideal calculated value. Some air may leak in during separation so that the actual pressure drop is not as extensive as theoretically calculated.

In fact, in tests conducted on prior art connectors, the pressure due to separation, was found to drop to 2–3 psi, or about 13.4–20% of atmospheric pressure. At these low levels, the dielectric strength was found to be unacceptably low. When the preferred embodiment of the present invention was measured, the pressure was found to drop to about 7–8 psi, or about 47.6 to 54.4% of atmospheric pressure. This reduction in pressure drop enabled the dielectric strength of air to remain at acceptable levels.

In the novel protective cap 160 shown in FIG. 6, the first space 190 between the insert 162 and female connector 100 significantly lessens the reduction in air pressure during separation to maintain the dielectric strength of the connector assembly. The volume of the first space 190 is increased to have a volume beyond that required for the parts to fit together so that the dielectric withstand level remains adequate, which prevents flashovers from occurring during separation of the parts. A similar amount of expansion may occur during separation, but the significantly larger initial volume of the first space 190 results in less of a pressure change. The pressure change during separation of the electrical connectors in FIG. 6 is about 69% of the original, or 10.14 psi, a pressure increase of 1.44 psi over the prior design shown in FIG. 4. This increase in pressure is sufficient to substantially eliminate flashover.

Although the foregoing description has been addressed primarily to the protective cap 160, those skilled in the art will readily appreciate that the same principles are used in forming the elbow connector 10 shown in FIG. 1 which maintains the dielectric strength of the surrounding air by increasing its initial volume.

Testing indicates that additional volume between the male and female connectors would further increase the resistance of the electrical connector assembly to flashover. FIG. 7 illustrates another embodiment of the invention in which an additional space has been introduced into a protective cap rearward of the locking ring. According to this embodiment, volume is added by extending a noncritical part of the insert.

As shown in FIG. 7, the exemplary protective cap 300 includes a semiconductive insert 310 which may comprise semiconductive EPDM. The insert 310 includes a locking ring 320 which mates with the corresponding locking groove 126 of the female connector 100. The protective cap 300 also includes a probe 358 which mates with the female contact member 120 of the female connector 100.

To further lessen the reduction in pressure during separation of the protective cap 300 from the female connector 100, additional space 330 is provided rearward of the locking ring 320. In a conventional protective cap, the distance A rearward of the locking ring is generally about equal to the corresponding length of the nose of the female connector 100. FIG. 4, for example, shows a conventional protective cap in which only a small space 246 remains between the end 249 of the female connector 200 and the inner end wall 248 of the insert. The space 246 in FIG. 4 has a depth of about 0.036 inches because the distance A in FIG. 4 is about 0.5150 inches, which is only slightly greater than the length of the end of the female connector 200 beyond the locking ring.

In FIG. 7, the distance A has been increased to provide additional space behind the locking ring 320. According to a preferred embodiment, the distance A is about 1.62 inches, which is 1.105 inches longer than the conventional protective cap of FIG. 4. The insert 310 thus provides an additional 1.105 inches of space behind the latch surface of the female connector 100. The increased initial volume of the space 330 rearward of the locking ring 320 results in much less of a drop in pressure during separation so that the dielectric strength of the air surrounding energized portions of the connectors remains relatively high to prevent flashovers. The following table illustrates the effect of varying the length A in FIG. 7 beyond the value of 0.515 inches. It is based on the net pressure during a normal separation on the order of 4.8 psi.

| Additional Length Behind Latch | Additional Volume | Total Initial Volume Vi | Added Volume as Cap or Elbow Separates | Total Volume When Separation Occurs Va | Volume Ratio $\frac{Vi}{Vs}$ | Separation Pressure (PSI) $\frac{Vi}{} \times 14.7$ | % of Normal Pressure |
|---|---|---|---|---|---|---|---|
| 0.1 | 0.0951 | 0.2484 | 0.31 | 0.557 | .446 | 6.55 | 134% |
| 0.2 | 0.1903 | 0.3436 | 0.31 | 0.653 | .526 | 7.74 | 159% |
| 0.3 | 0.2854 | 0.4387 | 0.31 | 0.748 | .587 | 8.62 | 177% |
| 0.4 | 0.3805 | 0.5338 | 0.31 | 0.843 | .633 | 9.31 | 191% |

-continued

| Additional Length Behind Latch | Additional Volume | Total Initial Volume Vi | Added Volume as Cap or Elbow Separates | Total Volume When Separation Occurs Va | Volume Ratio Vi/Vs | Separation Pressure (PSI) Vi × 14.7 | % of Normal Pressure |
|---|---|---|---|---|---|---|---|
| 0.5 | 0.4756 | 0.6290 | 0.31 | 0.938 | .671 | 9.86 | 202% |
| 0.6 | 0.5708 | 0.7241 | 0.31 | 1.033 | .701 | 10.30 | 211% |
| 0.7 | 0.6659 | 0.8192 | 0.31 | 1.128 | .726 | 10.67 | 219% |
| 0.8 | 0.7610 | 0.9143 | 0.31 | 1.223 | .747 | 10.99 | 225% |
| 0.9 | 0.8561 | 1.0095 | 0.31 | 1.319 | .766 | 11.25 | 231% |

As can be seen from the table, the internal/pressure during separation can be significantly increased with a relatively small increase in the length A resulting in a significant increase in dielectric strength. The length A can be increased to provide an adequate flashover resistance while accommodating manufacturing and user overall length considerations.

Figure 8A:
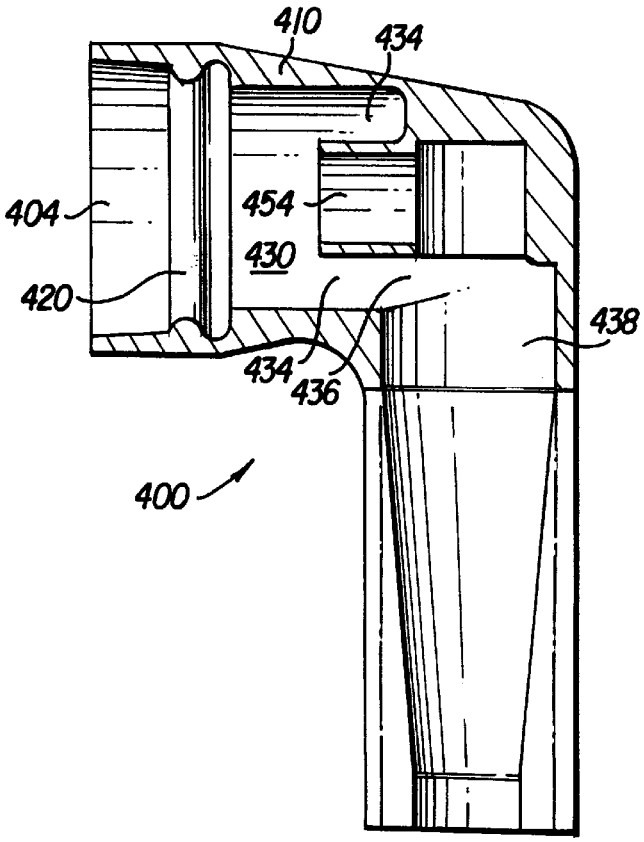
FIGS. 8*a*–8*b* illustrate portions of an elbow connector according to an another embodiment of the invention.
Figure 8B:
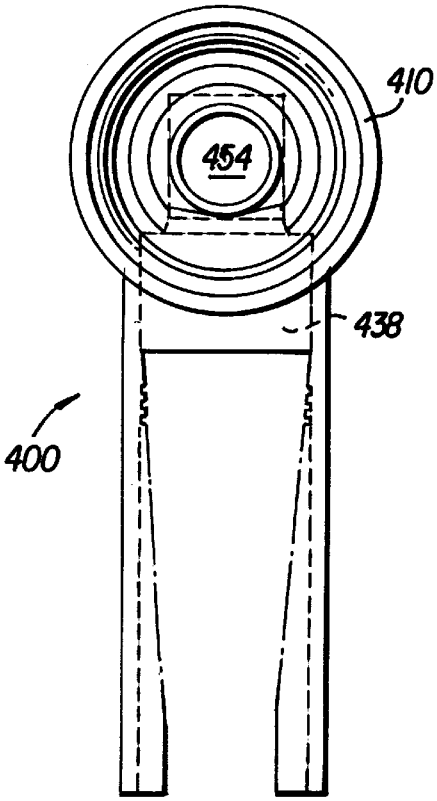

FIGS. 8*a*–8*b* illustrate another embodiment of the invention in which an additional volume has been added rearward of the locking ring. In FIG. 8*a*, an exemplary insert 410 is shown for an elbow connector 400. The insert 410 includes a conical space 404 for receiving the female connector 100, a first rearward space 430, and a locking ring 420 separating the conical space 404 from the first rearward space 430. The locking ring 420 mates with the locking groove 126 of the female connector 100 to retain the female connector 100 in the insert 410 of the elbow connector 400.

A second rearward space 434 extends rearward in the form of a cylinder which surrounds the end of the probe 454. The second rearward space 434 includes a connecting portion 436 which connects to a cable connection region 438 which surrounds the cable of the elbow connector. By fluidly connecting the cable connection region 438 with the first rearward space 430, the volume of air surrounding energized portions (e.g., the insert 410) of the connectors is significantly increased. In addition, the second rearward space 434 itself adds a significant additional volume in the form of a cylindrical recess.

The additional volume results in much less of a drop in pressure during disconnection of the elbow connector 400 from the female connector 100 since the initial volume of air is much greater than in a conventional elbow connector. The insert 410 shown in FIGS. 8*a*–8*c* can be formed by removing regions from a conventional insert. For example, a cylindrical cutout can be removed to produce the second rearward space 434 to add more volume to the air space between the elbow connector and the female connector. The second rearward space 434 can then be extended to form the connecting portion 436 which fluidly connects the cable connection region 438 to the first and second rearward spaces 430, 434.

Figure 9A:
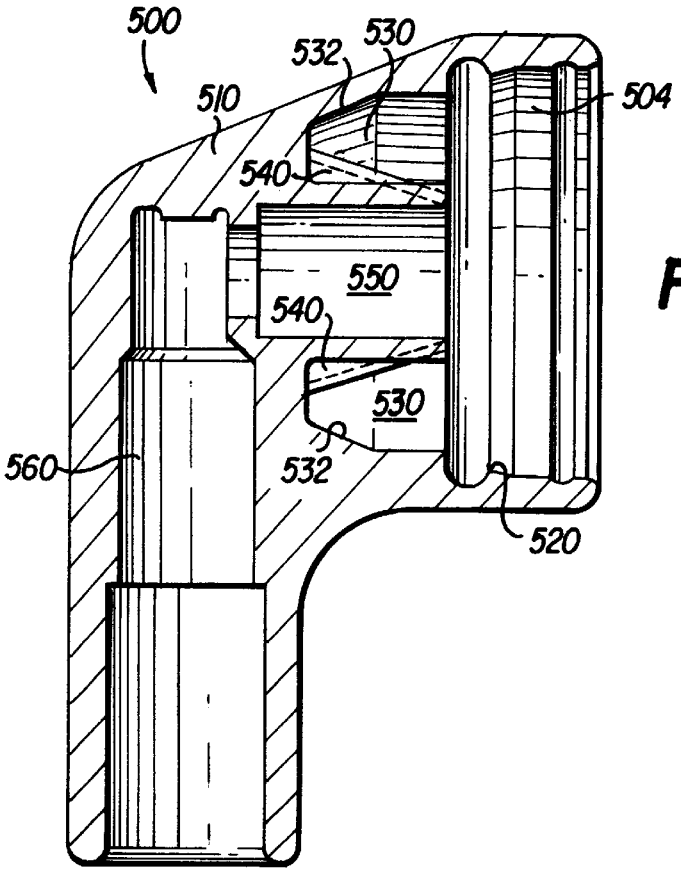
FIGS. 9*a*,9*b*,9*c* illustrate portions of an elbow connector according to another embodiment of the invention.
Figure 9B:
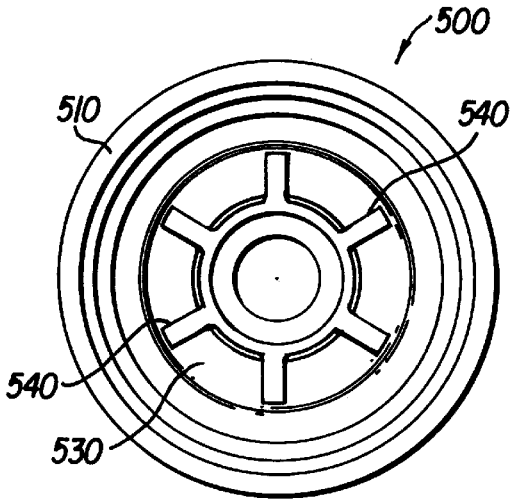
Figure 9C:
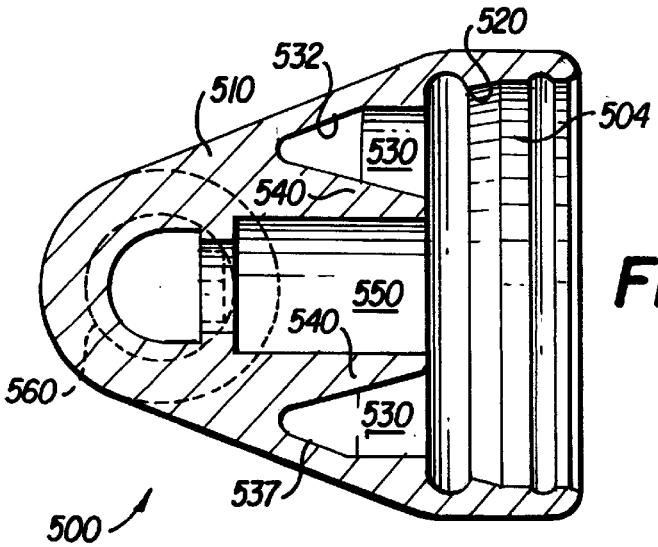

FIGS. 9*a*–9*c* illustrate portions of an elbow connector according to another embodiment of the invention. The elbow connector 500 includes a semiconductive insert 510 made of a material such as semiconductive EPDM. The insert 510 includes a bore 504 into which the end of a female connector 100 may be inserted. The insert 510 also includes a locking ring 520 which mates with a locking groove 126 on the female connector 100 to retain the female connector 100 in the insert 510 of the elbow connector 500.

Extending rearward from the locking ring 520 is an annular recess 530 which provides additional volume for air between the elbow connector 500 and the female connector 100 when the connectors are engaged. The annular recess 530 may be generally cylindrical in shape, with walls 532 which taper inward as they extend rearward from the locking ring 520.

The annular recess 530 may be supported by a plurality of ribs 540, as shown in FIG. 9*b*. The ribs 540 may be periodically spaced from each other, for example by 60 degrees, around the annular recess 530. The ribs 540 increase the strength of the insert 510.

Extending rearward from the plane of the locking ring 520 is an inner cylindrical space 550 which accommodates the probe of the elbow connector. The cylindrical space 550 is located radially inward from the annular recess 530 and ribs 540. The cylindrical space 550 preferably has an outer diameter which is greater than the outer diameter of the probe so that additional volume is provided which is in fluid communication with the female connector to maintain the pressure at a high level during separation. The cylindrical space 550 also preferably fluidly connects the cable connection region 560 with the air surrounding the female connector to further increase the initial air volume so that flashover is substantially eliminated.

As should be clear from the foregoing description, the criticality of the present invention does not lie in the specific shape, or even the specific initial volume, of the space between the connectors. Instead, the present invention results from taking advantage of the relationships between the change in volume of the initial space between the connectors, the effect that the change in volume has on the air pressure within the space, and the effect that the air pressure has on the dielectric strength of the air in the space.

Accordingly, a goal of the present invention is to provide a connector wherein the volume of the space between the connectors is increased. This limits a drop in pressure so as to maintain the dielectric strength of the air in the space at an acceptable level. In a preferred embodiment, the space between the connectors is increased by 3.5 times or less, and preferably less than 72%, as the connectors are separated, providing a drop in pressure to about 29% of atmospheric pressure, or to about 47.6, 54.4, or 72% of atmospheric pressure.

In other preferred embodiments, the space between the connectors is increased by 4, 5, or 6 times or less.

The above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims.

What is claimed is:

1. An electrical connector comprising:

a first member which includes:

an opening for receiving a second member;

a first electrical contact for making electrical contact with a second electrical contact of the second member; and a first retaining means which contacts a second retaining means on the second member to retain the second member in the first member;

wherein when the second member is retained in the first member, a space having a first volume is defined between the first member and the second member, and when the second member is removed from the first member to a point at which the first retaining means is not in contact with the second retaining means, but the second member is still retained in the first member, the space has a second volume and the minimum pressure in the space is about 4.2 psi absolute.

2. The electrical connector of claim 1, wherein the minimum pressure is about 7 psi absolute.

3. The electrical connector of claim 1, wherein the minimum pressure is about 8 psi absolute.

4. The electrical connector of claim 1, wherein the minimum pressure is about 10.6 psi absolute.

5. The electrical connector of claim 1, wherein the first member comprises an elbow connector and the first electrical contact comprises a metal probe.

6. The electrical connector of claim 1, wherein the first member comprises a material which stretches as the second member is removed from the first member.

7. The electrical connector of claim 1, wherein the space is substantially cylindrical.

8. An electrical connector comprising:

a first member which includes:

an opening for receiving a second member;

a first electrical contact for making electrical contact with a second electrical contact of the second member; and a first retaining means which contacts a second retaining means on the second member to retain the second member in the first member;

wherein when the second member is retained in the first member, a space having a first volume is defined between the first member and the second member, and when the second member is removed from the first member to a point at which the first retaining means is not in contact with the second retaining means, but the second member is still retained in the first member, the space has a maximum volume of 6 times the first volume.

9. The electrical connector of claim 8, wherein the maximum volume is 39% larger than the first volume.

10. The electrical connector of claim 8, wherein the maximum volume is five times the first volume.

11. The electrical connector of claim 8, wherein the maximum volume is four times the first volume.

12. The electrical connector of claim 8, wherein the maximum volume is 3.5 times the first volume.

13. The electrical connector of claim 8, wherein the maximum volume is twice the first volume.

14. A method of breaking an electrical connection comprising the steps of:

providing a first electrical connector which includes a first electrical contact and a first retaining surface;

inserting into the first electrical connector to a retained position in a second electrical connector which includes a second electrical contact which mates with the first electrical contact and a second retaining surface which mates with the first retaining surface;

providing a space between the first electrical connector and the second electrical connector when the second electrical connector is inserted into the first electrical connector, wherein the space has a first volume in the inserted position;

removing the second electrical connector from the first electrical connector to a point at which the second retaining surface is no longer retained in the first retaining surface, but the second electrical connector is still retained in the first electrical connector, at which point the space has a second volume, wherein a ratio of the second volume to the first volume is about 3.5 or less.

15. The method of claim 14, wherein the ratio is about 1.39 or less.

16. The method of claim 14, wherein the ratio is about 6 or less.

17. The method of claim 14, wherein the ratio is about 5 or less.

18. The method of claim 14, wherein the ratio is about 4 or less.

19. A method of breaking an electrical connection comprising the steps of:

providing a first electrical connector which includes a first electrical contact and a first retaining surface;

inserting into the first electrical connector to a retained position in a second electrical connector which includes a second electrical contact which mates with the first electrical contact and a second retaining surface which mates with the first retaining surface;

providing a space between the first electrical connector and the second electrical connector when the second electrical connector is inserted into the first electrical connector, wherein the space has a first volume in the inserted position;

removing the second electrical connector from the first electrical connector to a point at which the second retaining surface is no longer retained in the first retaining surface, but the second electrical connector is still retained in the first electrical connector, at which point the space has a second volume and a minimum pressure of 4.2 psi absolute.

20. The method of claim 19, wherein the minimum pressure is 7 psi absolute.

21. The method of claim 19, wherein the minimum pressure is 8 psi absolute.

22. The method of claim 19, wherein the minimum pressure is 10.6 psi absolute.

23. An electrical connector comprising:

a first member which includes:

an opening that is closed at a first end and which receives a second member through a second end of the opening;

a first electrical contact within the opening for making electrical contact with a second electrical contact of the second member; and a first retaining means within the opening which contacts a second retaining means on the second member to retain the second member in the first member;

wherein a portion of the opening between the first end and the first retaining means is substantially cylindrical so as to create a volume that provides a clearance between the first member and the second member within the opening.

24. The electrical connector of claim 23, wherein the volume is greater than 0.25 cubic inches.

* * * * *